US006725898B2

(12) United States Patent
Mullet et al.

(10) Patent No.: US 6,725,898 B2
(45) Date of Patent: Apr. 27, 2004

(54) INSULATED SECTIONAL DOOR AND METHOD OF CONSTRUCTION

(75) Inventors: Willis J. Mullet, Gulf Breeze, FL (US); Dewayne J. Davidson, Pace, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 10/124,516

(22) Filed: Apr. 17, 2002

(65) Prior Publication Data

US 2003/0196767 A1 Oct. 23, 2003

(51) Int. Cl.[7] ..... E06B 3/00
(52) U.S. Cl. ..... 160/232; 52/455; 52/784.15
(58) Field of Search ..... 160/229.1, 201, 160/232, 405; 52/455, 71, 784.1, 784.13, 784.15

(56) References Cited

U.S. PATENT DOCUMENTS 3,178,776 A * 4/1965 Stansberry ..... 160/201
4,284,119 A * 8/1981 Martin et al. ..... 160/232
4,339,487 A 7/1982 Mullet ..... 428/71
4,685,266 A * 8/1987 Mullet ..... 52/309.11
5,177,868 A 1/1993 Kyle et al. ..... 29/897.32
5,419,386 A * 5/1995 Magro et al. ..... 160/232
5,509,457 A 4/1996 Jella ..... 160/201
5,787,677 A * 8/1998 Bolich et al. ..... 52/784.15
6,155,070 A 12/2000 Rust, Jr. et al. ..... 62/404

* cited by examiner

*Primary Examiner*—David Purol
(74) *Attorney, Agent, or Firm*—Renner, Kenner, Greive, Bobak, Taylor & Weber

(57) ABSTRACT

A door (10) made in accordance with the present invention includes a plurality of panels (20) with opposed stiles (24, 25) being positioned at the longitudinal edges of a faceplate (21) of each panel (20) and with opposed rails (26, 27) being positioned at the lateral edges of the faceplate (21) of each panel (20). An insulation assembly (30) includes a sheet of insulation material (31) and a backing sheet (32) which has edges (33) which overhang the lateral edges of the sheet of insulation material (31). The insulation assembly (30) is installed in the door (10) by engaging the stiles (24, 25) with the longitudinal edges of the sheet of insulation material (31) to flex the same until the edges are received in notches (34) formed in the stiles (24, 25). Then the overhanging edges (33) of the backing sheet (32) engage the rails (26, 27) and deform to press the sheet of insulation material (31) against the faceplate (21).

18 Claims, 3 Drawing Sheets

INSULATED SECTIONAL DOOR AND METHOD OF CONSTRUCTION

TECHNICAL FIELD

This invention relates to an insulated sectional door, such as a residential garage door, and its method of assembly. More specifically, this invention relates to such a door wherein the insulation is attached thereto without the need for gluing or the use of separate fasteners.

BACKGROUND ART

Sectional doors, such as garage doors or the like, are typically formed with hinged panels having opposed, spaced sheets or skins of material, with preferably an insulation material positioned therebetween. Such panels are not conveniently manufactured in that the insulation must be firmly adhered to the skins to form an integral unit. In some instances the front and rear skins are preheated and have a hot melt adhesive applied thereto. Then the core made of an insulation material is placed between the skins, and the assembly is passed through pinch rollers to assure adhesion of the components. In another process, a polyurethane foam may be sprayed into the area between the skins and then, when heated, the foam expands to fill the volume of space between the skins.

These methods of manufacturing of an insulated door not only add to the costs thereof, but also they have additional disadvantages. For example, such doors will have a predetermined, fixed quantity of insulation and, as such, in order for the retail establishment to be able to satisfy varying customer demands regarding the desired quantity of insulation, it will have to inventory a large number of doors. Moreover, oftentimes a customer may want to increase the insulation in his door, but such cannot be accomplished. Thus, in such instances, and in other instances such as door damage, rather than being able to replace the insulation, a new door must be purchased.

As a result of these drawbacks, a door having panels without insulation, that is, a door with just one skin, and commonly known as a pan door, has become popular. The advantage of such pan doors is that a door retailer or installer need only stock one type of door while at the same time carrying skin-backed insulation sheets of varying sizes. Thus, when a door is sold, the retailer can install the amount of insulation desired by the customer in the door, selected from his inventory of skin-backed insulation sheets.

The drawback of the pan doors is that currently a separate component must be utilized to attach the desired insulation to the pan door. Typical separate components are clips, brackets or the like, or glue. The problem with glue is that a solvent-based glue cannot be utilized, otherwise the foam insulation would deteriorate. Thus, any glue which would be suitable is slow drying, often requiring days of drying before the door could be installed. The slow drying nature of the glue also prohibits changing the existing insulation of a customer at the site.

Oftentimes installers will add clips to the door to retain the insulation while the glue is drying so that the door can be installed before the glue is dry, but such not only adds to the cost of the product, but also renders the door subject to other problems created by the clip fasteners. These problems include the fact that clips may loosen and, unless also properly glued, the door may separate during use or, at a minimum, become very noisy. Moreover, with the use of only clip fasteners, the foam will not be compressed which is a requirement for sound deadening.

Some attempts have been made to utilize the side rails of the door panel as the component which provides the means by which the foam may be attached. In these situations, the rails are provided with an undercut to receive the edges of the foam insulation material. However, that form must be bent in an arc for insertion between the rails, and such is only possible with thinner, more rigid, foams. When thicker insulation is desired, the foam material must be more flexible, rendering it more difficult to be retained in a moving door. Thus, in these instances, retaining brackets or straps may have to be added. Even then, without proper compression of the foam, the problems of a lack of sound deadening and foam loosening may well exist in these doors just as in the doors where the foam is clipped in place.

The only known system which may allow the foam to be installed or changed on site provides a foam sheet with a backing material that is peripherally larger than the foam at the location of the rails of the panels. However, unless a further retention device such as glue is employed, thermal expansion and contraction of the foam and its backing will loosen the fit thereof to the point where the foam and backing could fall out of the door.

Thus, the need exists for an overhead door with insulation that can be installed in the field without the need for any additional fasteners or fastening materials such as glue or the like.

DISCLOSURE OF THE INVENTION

It is thus an object of the present invention to provide garage doors or the like which can be provided with insulation without the use of any separate fastening device.

It is another object of the present invention to provide garage doors, as above, which do not require glue to be assembled and which can therefore be put into service immediately after assembly.

It is a further object of the present invention to provide garage doors, as above, which can be assembled with differing insulation characteristics and yet only one style of door needs to be stocked by the retailer.

It is an additional object of the present invention to provide garage doors, as above, which can be assembled in the field with various sizes of insulation without the need to change any other door component.

It is yet another object of the present invention to provide garage doors, as above, in which the insulation is held compressed in place so that it will not loosen to cause deterioration of the door.

It is a still further object of the present invention to provide garage doors, as above, in which thicker sheets of insulation can be used even under the compression conditions.

It is still another object of the present invention to provide garage doors, as above, which can be quickly assembled.

These and other objects of the present invention, as well as the advantages thereof over existing prior art forms, which will become apparent from the description to follow, are accomplished by the improvements hereinafter described and claimed.

In general, a door made in accordance with the concepts of the present invention includes a plurality of panels, each of which includes opposed rails and a faceplate extending laterally between the rails. A sheet of insulation material has lateral edges positioned adjacent to the rails. A backing sheet is attached to the sheet of insulation material and has lateral edges which overhang the lateral edges of the insulation sheet such that the lateral edges of the backing sheet engage the rails to hold the insulation sheet against the faceplate.

In accordance with the present invention, a sectional door panel includes a pair of spaced rails with at least two stiles extending between the rails. A faceplate is integral with and extends between the rails and overlies the stiles. An insulating sheet extends between the stiles and proximate the rails. Means associated with the insulating sheet are provided to engage the rails to maintain the insulating sheet pressed against the faceplate.

Also in accordance with the present invention, a method of assembling a door having laterally spaced rails and a faceplate extending therebetween includes the steps of attaching a backing sheet to a sheet of insulation material, with the backing sheet having lateral edges overhanging the lateral edges of the sheet of insulation material, and engaging the rails with the lateral edges of the backing sheet to press the sheet of insulation material against the faceplate.

The present invention also contemplates a method of installing insulation into a door having a faceplate with lateral edges defined by rails and longitudinal edges defined by stiles. The insulation material has a backing sheet which overhangs the lateral edges of the material. The insulation material is installed by positioning its longitudinal edges adjacent to the stiles and by positioning the overhanging portion of the backing sheet into engagement with the rails which deforms the overhanging portion thereby pressing the insulation material against the faceplate.

A preferred exemplary overhead garage door incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
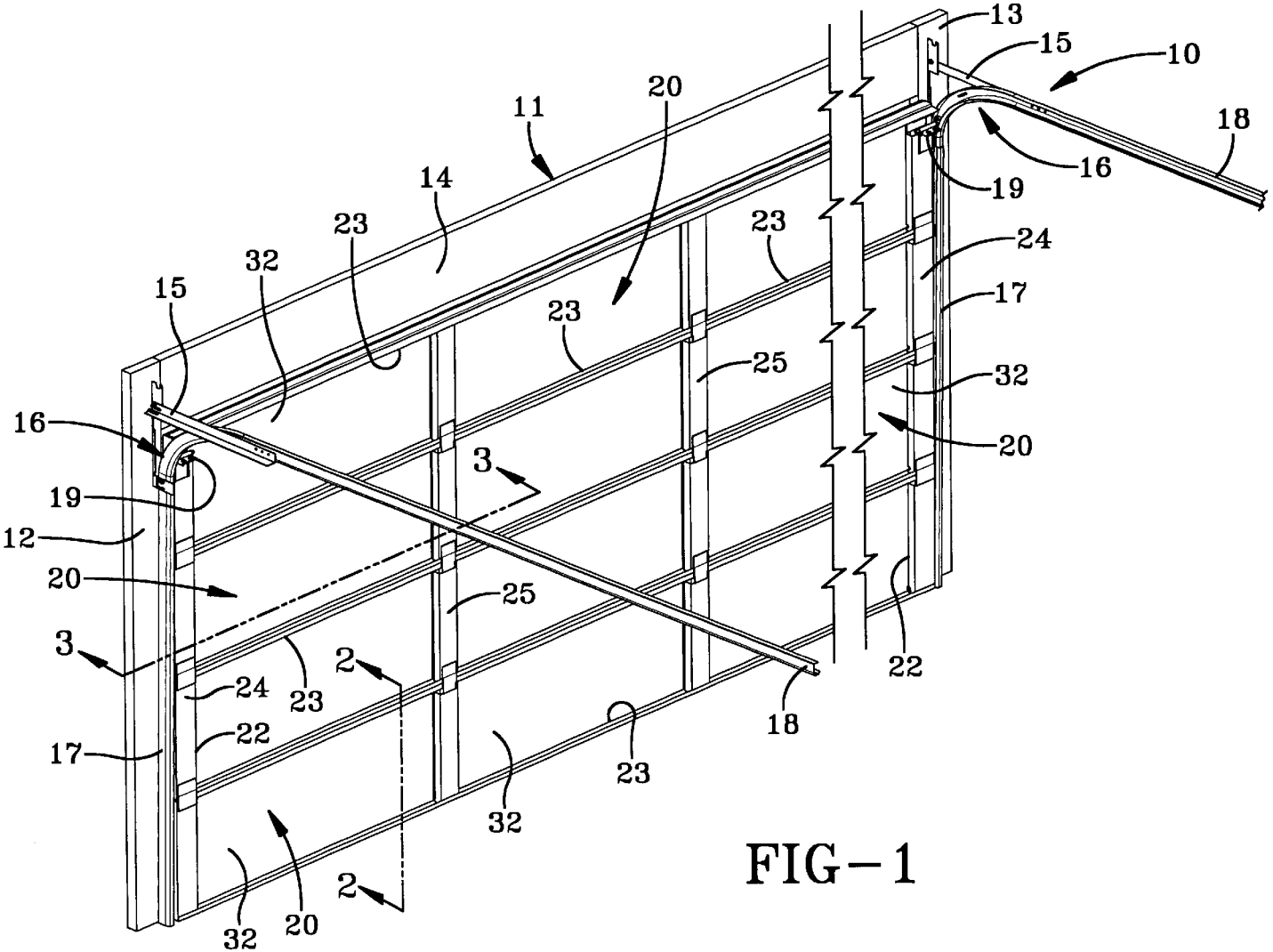
FIG. 1 is a somewhat schematic, fragmentary, perspective view of an overhead garage door which is constructed in accordance with the concepts of the present invention.

A sectional overhead door, of a type employed for garages of residential housing, and made in accordance with the present invention, is generally indicated by the numeral 10 and shown somewhat schematically in FIG. 1. Door 10 is shown as being positioned for opening and closing movements within a frame generally indicated by the numeral 11. Frame 11 includes a pair of spaced jambs 12, 13 that are generally parallel and extend vertically upward from the floor (not shown). Jambs 12 and 13 are joined at their upper extremity by a header 14 to thereby define a generally inverted U-shaped frame 11 which is usually made of lumber so as to facilitate attachment of elements which support and control door 10.

Frame 11 is provided with angle irons 15 carried by jambs 12 and 13. Angle irons 15 support tracks, generally indicated by the numeral 16, which are thereby positioned on either side of door 10. Tracks 16 include a generally vertical section 17 and a generally horizontal overhead section 18. A plurality of conventional roller assemblies 19 (only two shown) are carried by the spaced longitudinal edges of door 10 and ride in tracks 16. Thus, as door 10 is being opened, usually by a conventional operator (not shown), rollers 19 ride in the vertical sections 17 of tracks 16 and then in the horizontal overhead sections 18.

Door 10 includes a plurality of sections or panels generally indicated by the numeral 20. Each panel 20 includes a skin or a faceplate 21 which is preferably made of a light-weight, metallic material such as galvanized steel, and since faceplates 21 form the outer surface of door 10, they may be embossed for strengthening and for decoration, as desired. Faceplates 21 provide panels 20 with spaced longitudinal edges 22 and spaced lateral edges 23 which are spaced vertically from each other. Typically, a lateral edge 23 of a panel 20 is hinge connected to a lateral edge 23 of an adjacent panel 20 to form an integral door 20.

Each door panel 20 includes end stiles 24 and intermediate stiles 25 which are vertically oriented within door 10. The end stiles 24 receive the longitudinal edges 22 of panel faceplates 21. Thus, panels 20 at the edges of door 10 adjacent to tracks 16 have faceplates 21 terminated at the end stiles 24. The intermediate stiles 25 support and reinforce the faceplates 21 at spaced locations longitudinally thereof in a conventional manner.

Figure 2:
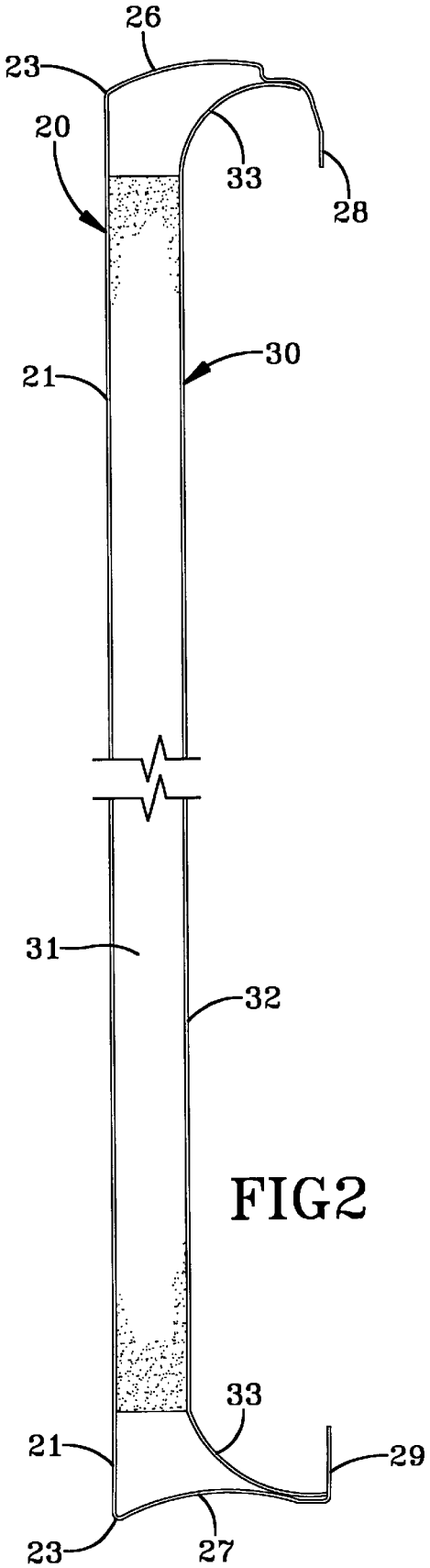
FIG. 2 is a fragmentary sectional view taken substantially along line 2—2 of FIG. 1 and showing the insulation material installed in a door panel.

As best seen in FIG. 2, an upper horizontal rail 26 and a lower horizontal rail 27 are formed at the lateral edges 23 of each faceplate 21. Rails 26 and 27 are configured so as to compliment each other so as to be in close proximity but with no interference between adjacent rails 26 and 27 of adjacent panels 20 when door 10 is being opened and closed. As shown in FIG. 2, rails 26 and 27 each terminate with a return surface 28 and 29, respectively. Return surfaces 28 and 29 extend laterally, inwardly toward each other, and they are spaced from and generally parallel to faceplate 21.

As described to this point, door 10 is without insulation and is generally known as a pan door which is capable of receiving insulation. According to the present invention, the retailer or door installer can stock a large number of such doors 10 and then quickly and easily create a custom door with a specified insulation thickness by utilizing one of a plurality of insulation assemblies that can be maintained in inventory.

Figure 2A:
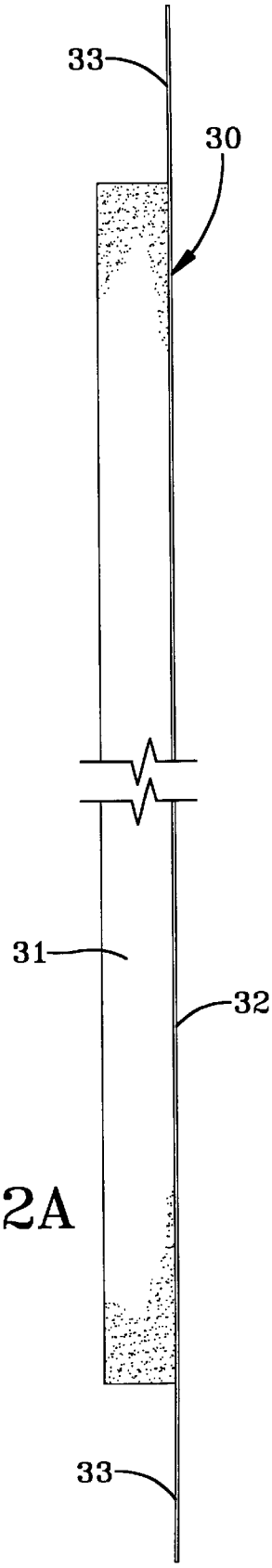
FIG. 2A is a fragmentary sectional view of the insulation material shown in a condition prior to being installed in the door panel as shown in FIG. 2.

One such insulation assembly is shown in FIG. 2A and is generally indicated by the numeral 30. Insulation assembly 30 includes an insulation sheet 31 of a foam material, such as expanded polystyrene, polyurethane, polyethylene, or the like, and a backing sheet 32 constructed of a thin, semi-rigid, yet deformable material such as any suitable metallic material, polystyrene, polyvinylchloride, or the like. Backing sheet 32 can be bonded or otherwise fused to insulation sheet 31 during the manufacture of the foam material in a manner well known to persons skilled in the art.

Figure 3:
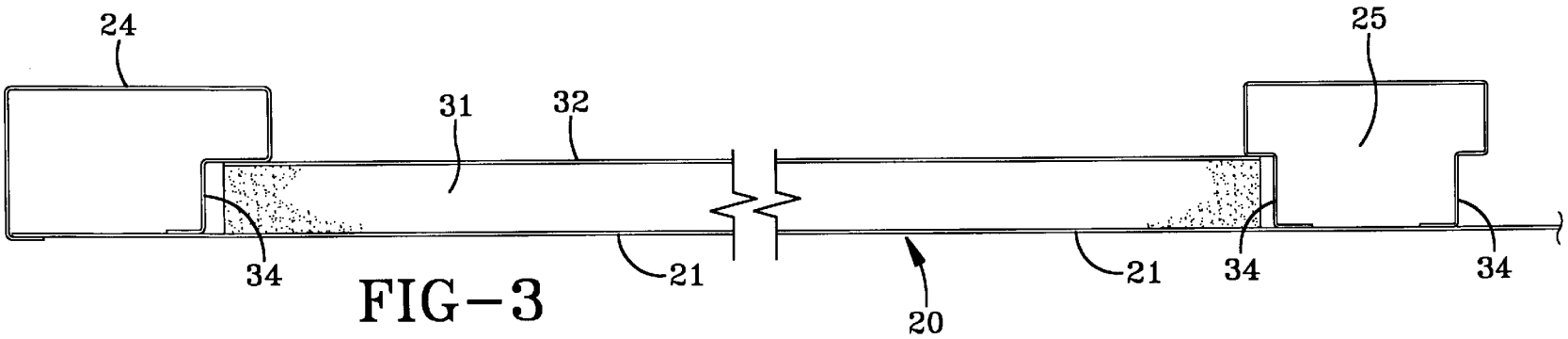
FIG. 3 is a fragmentary sectional view taken substantially along line 3—3 of FIG. 1 and showing the insulation material installed in a door panel.
Figure 3A:
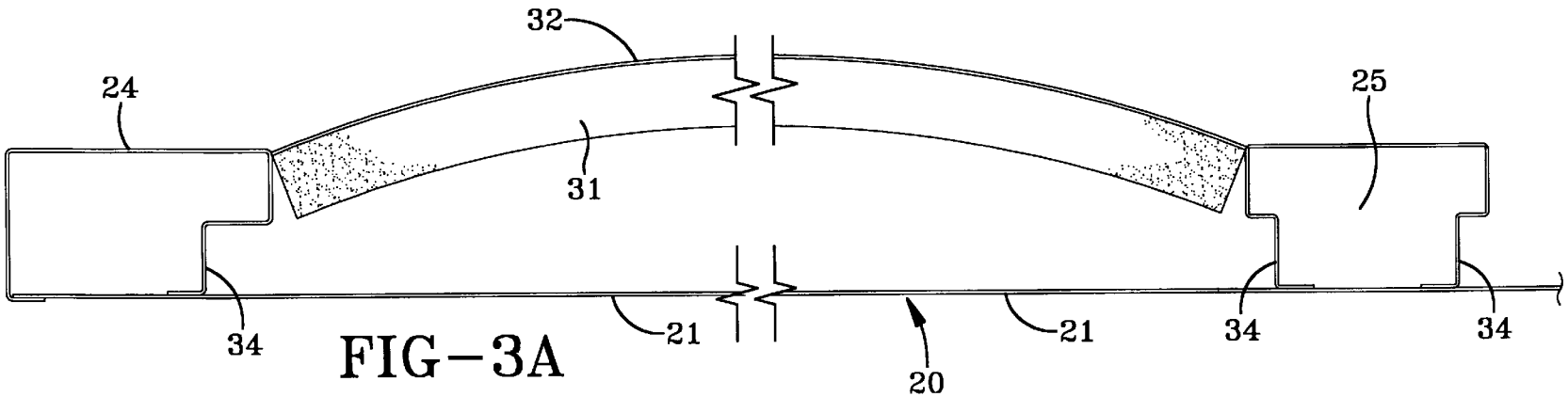
FIG. 3A is a fragmentary sectional view of the insulation material shown as it is being installed in the door panel as shown in FIG. 3.

As shown in FIG. 2A, in the lateral direction of each panel 20, that is, between rails 26 and 27, backing sheet 32 extends beyond or otherwise overhangs the edges of insulation sheet 31, as at overhangs 33. It should be appreciated that backing sheet 32 need not be a separate element. Rather, the overhangs 33 could be formed as an extension of a portion of the insulation sheet 31 just so long as the overhangs 33 have sufficient strength and resilience to perform the functions hereinafter described. In the longitudinal direction of each panel 20, that is, between stiles 24 and 25, or between two stiles 25, backing sheet 32 may be generally coincident with the edges of insulation sheet 31 as shown in FIGS. 3 and 3A. However, the longitudinal dimension of insulation assembly 30 is greater than the distance between stiles 24 and 25 or adjacent stiles 25. As a result, to install insulation assembly 30 into door 10, insulation sheet 31 and backing sheet 32 must be deflected or bowed, as shown in FIG. 3A, so that the ends thereof will clear stiles 24 and 25. It should be noted that stiles 24 and 25 are provided with opposed relieved areas or notches 34 adjacent to faceplate 21, end stiles 24 having one such relieved area 34, and intermediate stiles 25 have two relieved areas 34. Once the longitudinal ends of the deflected assembly 30 reach the relieved areas 34 in stiles 24 and 25, insulation assembly 30 can straighten, as shown in FIG. 3. This action of "popping" the assembly 30 into place causes the overhangs 33 to bend within rails 26 and 27 with the ends of the overhangs 33 engaging return surfaces 28 and 29 as shown in FIG. 2. This deformation of the overhangs 33 holds the foam insulation sheet 31 compressed against faceplate 21 as shown in FIG. 2. No tools or separate fasteners are therefore needed to install the insulation assembly 30. The larger spacing of the stiles 24, 25, normally being on the order of 36 inches or more, facilitates the bowing of insulation sheet 31 along its lateral axis whereas the more pliable overhangs 33 of backing sheets 32 are readily insertable within rails 26, 27 which are normally spaced on the order of 18 inches without bowing insulation sheet 31 along its longitudinal axis.

It should be evident that the door retailer or installer can stock several different insulation assemblies 30 to thereby create a door 10 with the insulation quality and thickness requested by the customer. The difference between these assemblies is that the insulation sheet 31 can be made thicker or thinner dependent on the amount of insulation desired. It has been found that the system described herein is readily operable using foam insulation sheets 31 in the range of approximately one-half inch thick to approximately one and one-half inches thick. It should be appreciated that as the foam insulation sheet 31 becomes thicker, shorter overhangs 33 are employed to fill rails 26 and 27 and engage surfaces 28 and 29.

In view of the foregoing, it should be evident that a door 10 constructed in accordance with the concepts of the present invention can readily be assembled in the field, or the insulation quality of an existing door can readily be changed. As such, door 10 accomplishes one or more of the objects of the invention and otherwise substantially improves the art.

What is claimed is:

1. A door comprising a plurality of panels, each said panel having opposed rails and a faceplate extending laterally between said rails, a sheet of insulation material having laterally spaced edges positioned adjacent to said rails, and a backing sheet attached to said sheet of insulation material and having lateral edges overhanging the lateral edges of said sheet of insulation material such that the lateral edges of said backing sheet engage said rails to hold said sheet of insulation material against said faceplate.

2. The door according to claim 1 further comprising opposed stiles for each said panel, said faceplate extending longitudinally between said stiles.

3. The door according to claim 2, each said stile having at least one notch to receive the longitudinal edges of said sheet of insulation material and said backing sheet.

4. The door according to claim 3 wherein said opposed stiles are closer to each other than the longitudinal dimension of said sheet of insulation material such that said sheet of insulation material can be bowed for insertion between said stiles and straightens when said longitudinal edges are received in said notches.

5. The door according to claim 1 wherein each said rail includes a return surface spaced from and generally parallel to said faceplate.

6. The door according to claim 5 wherein the lateral edges of said backing sheet engage said return surfaces of said rails.

7. The door according to claim 1 wherein said sheet of insulation material is a foam and said backing sheet is constructed of a relatively deformable material.

8. The door according to claim 7 wherein said foam is of a thickness in the range of approximately one-half inch to approximately one and one-half inches.

9. The door according to claim 8 wherein the length of the overhanging edges of said backing sheet is dependent on the thickness of said foam.

10. A method of assembling a door having laterally spaced rails and a faceplate extending between the rails, comprising the steps of attaching a backing sheet to a sheet of insulation material with the backing sheet having lateral edges overhanging the sheet of insulation material, and engaging the rails with the lateral edges of the backing sheet to press the sheet of insulation material against the faceplate.

11. The method of claim 10, the door having longitudinally spaced stiles with the faceplate extending between the stiles, further comprising the step of engaging the stiles with the longitudinal edges of the backing sheet.

12. The method of claim 11 wherein the stiles include at least one notch and the step of engaging the stiles includes the step of positioning the longitudinal edges of the insulation material in the notches of opposed stiles.

13. The method of claim 12 further comprising the step of engaging the stiles with the longitudinal edges of the insulation material thereby flexing the insulation material prior to positioning the insulation material in the notches.

14. The method of claim 10 further comprising the step of decreasing the length of the overhang of the backing sheet when increasing the thickness of the insulation material.

15. A method of installing an insulation material, having a backing sheet with a portion overhanging the lateral edges of the material, into a panel of a door having a faceplate with lateral edges defined by rails and longitudinal edges defined by stiles, comprising the steps of positioning the longitudinal edges of the insulation material adjacent to the stiles, and bringing the overhanging portion of the backing sheet into engagement with the rails to deform the overhanging portion thereby pressing the insulation material against the faceplate.

16. The method of claim 15 wherein the stiles include at least one notch and the step of positioning the longitudinal edges of the insulation material adjacent to the stiles includes the step of positioning the longitudinal edges of the insulation material in the notches.

17. The method of claim 16 wherein the step of positioning the longitudinal edges of the insulation material adjacent to the stiles includes the step of flexing the insulation material.

18. A sectional door comprising a pair of spaced rails, at least two stiles extending between said rails, a faceplate extending between said rails and overlying said stiles, an insulating sheet extending between said stiles and having edges proximate said rails, and means associated with said insulating sheet having edges overhanging said edges of said insulating sheet for engaging said rails to press said insulating sheet against said faceplate.

* * * * *